US011629833B1

(12) United States Patent
Wu

(10) Patent No.: US 11,629,833 B1
(45) Date of Patent: Apr. 18, 2023

(54) VEHICLE LAMP

(71) Applicant: COPLUS INC., Tainan (TW)

(72) Inventor: Jacob Wu, Tainan (TW)

(73) Assignee: COPLUS INC., Tainan (TW)

( * ) Notice: Subject to any disclaimer, the term of this patent is extended or adjusted under 35 U.S.C. 154(b) by 0 days.

(21) Appl. No.: 17/956,817

(22) Filed: Sep. 29, 2022

Related U.S. Application Data

(60) Provisional application No. 63/397,706, filed on Aug. 12, 2022.

(51) Int. Cl.
*F21S 41/24* (2018.01)
*F21S 41/143* (2018.01)

(52) U.S. Cl.
CPC ..... *F21S 41/24* (2018.01); *F21S 41/143* (2018.01)

(58) Field of Classification Search
CPC ..... F21S 43/243; F21S 43/249; F21S 43/239; F21S 43/241; F21S 41/24; F21S 41/143
See application file for complete search history.

(56) References Cited

U.S. PATENT DOCUMENTS 6,739,738 B1 * 5/2004 Smith ..... F21S 43/315 362/326
8,047,675 B1 * 11/2011 Millikan ..... G02B 19/0028 362/555
10,400,974 B2 * 9/2019 Kanayama ..... F21S 41/663
11,378,244 B2 * 7/2022 Sugiyama ..... F21S 41/322

* cited by examiner

*Primary Examiner* — Matthew J. Peerce
(74) *Attorney, Agent, or Firm* — Chun-Ming Shih; HDLS IPR Services

(57) ABSTRACT

A vehicle lamp includes a lamp housing, a carrier board, LEDs, and an optical unit. The lamp housing includes an accommodating space and an opening connecting the accommodating space. The carrier board is disposed in the accommodating space, and a front surface of the carrier board facing the opening. The LEDs are disposed on the front surface of the carrier board. The optical unit includes a light guide plate, light guide members and beam pattern adjusting structures. The light guide plate includes an upper surface and a lower surface, and the light guide plate covers the opening with the lower surface facing the carrier board. The light guide member protrudes on the lower surface, and each light guide member extends towards one LED. The beam pattern adjusting structures protrude on the upper surface, and each beam pattern adjusting structure is arranged to correspond at least one light guide member.

14 Claims, 11 Drawing Sheets

VEHICLE LAMP

CROSS-REFERENCE TO RELATED APPLICATIONS

This application claims an invention which was disclosed in Provisional Application No. 63/397,706, filed on August 8th. The benefit under 35 USC § 119(e) of the United States provisional application is hereby claimed, and the aforementioned application is hereby incorporated herein by reference.

BACKGROUND

Technical Field

This disclosure is related to vehicle parts, in particular to a vehicle lamp.

Related Art

The structure of an LED vehicle lamp in the art includes a lamp housing, an LED carrier board, optical units respectively covering each LED, and a light transmissive cover. The optical units are respectively fixed to a corresponding one of the LEDs, such that the quantity of LED vehicle lamp parts is increased and production cost increases. In addition, the optical units are fixed to the LED carrier board, and it is not easy to alter the optical units.

In addition, the intensity of light will gradually decrease as it passes through an optical medium. In a LED vehicle lamp in the art, the light emitted from a LED has to pass through the optical unit and light transmissive cover that cover this individual LED, i.e., the light has to pass through two optical media, which will cause a higher degree of light intensity degradation. In order to maintain sufficient illumination, the power of LEDs has to be increased, which makes LEDs more costly to set up. At the same time, the high power operation also results in shorter LED life and heat dissipation problems.

SUMMARY

In view of the above problem, this disclosure provides a vehicle lamp. In this vehicle lamp, a single optical unit is utilized to replace the light transmissive cover and plural optical units on each of the LEDs in the art.

This disclosure provides a vehicle lamp, which includes a lamp housing, a carrier board, a plurality of LEDs, and an optical unit. The lamp housing includes an accommodating space and an opening connecting the accommodating space. The carrier board is disposed in the accommodating space, and a front surface of the carrier board faces the opening. The LEDs are disposed on the front surface of the carrier board. The optical unit includes a light guide plate, a plurality of light guide members, and a plurality of beam pattern adjusting structures.

The light guide plate includes an upper surface and a lower surface, and the light guide plate covers the opening, and the lower surface of the light guide plate faces the carrier board.

The light guide members protrude on the lower surface, and each of the light guide members extends towards one of the LEDs, the beam pattern adjusting structures protrude on the upper surface, and each of the beam pattern adjusting structures corresponds at least one of the light guide members.

In at least one embodiment, a projection of each of the beam pattern adjusting structures of the upper surface of the light guide plate overlaps with the projection of the corresponding light guide member on the lower surface of the light guide member.

In at least one embodiment, the beam pattern adjusting structures include different heights on the upper surface of the light guide plate.

In at least one embodiment, heights of the beam pattern adjusting structures located within a center area of the upper surface are higher than the heights of the beam pattern adjusting structures located outside the center area.

In at least one embodiment, projections of the least one of the beam pattern adjusting structures on the upper surface are rectangular, and each of the projection includes long sides and short sides.

In at least one embodiment, the upper surface includes a center area and a peripheral area surrounding the center area, and each of the beam pattern adjusting structures in the center area are arranged with the long sides parallel to the long sides of other beam pattern adjusting structure.

In at least one embodiment, the upper surface includes a center area and a peripheral area surrounding the center area, and the beam pattern adjusting structures in the peripheral area are arranged with long sides in radial arrangement.

In at least one embodiment, lateral surfaces of each of the beam pattern adjusting structures corresponding to the long sides of the beam pattern adjusting structure are inclined surfaces, and an included angle between each of the inclined surfaces and the upper surface of the light guide plate is smaller than 90 degrees.

In at least one embodiment, lateral surfaces of each of the beam pattern adjusting structures corresponding to the long sides of the beam pattern adjusting structure are concave curved surfaces or convex curved surfaces.

In at least one embodiment, lateral surfaces of each of the beam pattern adjusting structures corresponding to the long sides of the beam pattern adjusting structure are planar surfaces perpendicular to the upper surface of the light guide plate.

In at least one embodiment, lateral surfaces of each of the beam pattern adjusting structures corresponding to the short sides of the beam pattern adjusting structure are inclined surfaces, and an included angle between each of the inclined surfaces and the upper surface of the light guide plate is smaller than 90 degrees.

In at least one embodiment, lateral surfaces of each of the beam pattern adjusting structures corresponding to the short sides of the beam pattern adjusting structure are concave curved surfaces or convex curved surfaces.

In at least one embodiment, lateral surfaces of each of the beam pattern adjusting structures corresponding to the short sides of the beam pattern adjusting structure are planar surfaces perpendicular to the upper surface of the light guide plate.

In at least one embodiment, a top surface of each of the beam pattern adjusting structures is an optical diffusion surface with concave and convex structures.

In at least one embodiment, a top surface of each of the beam pattern adjusting structures is a planar surface.

In at least one embodiment, the lamp housing further includes a fixing post disposed in the accommodating space for supporting and fixing the carrier board.

Through the above-mentioned approach, the light transmissive cover and optical units on each of the LEDs in the art are replaced by a single optical unit in this disclosure. Therefore, a structure of the vehicle lamp is simplified, and the optical unit can be easily replaced. In addition, in this disclosure, the light only needs to pass through one optical medium, and no longer needs to pass through the light transmissive cover, which greatly reduces the illumination degradation rate. Therefore, in this disclosure, the operation power of individual LEDs can be reduced, which improves LED life, reduces heat dissipation problems, and reduces production cost.

BRIEF DESCRIPTION OF THE DRAWINGS

This disclosure will become more fully understood from the detailed description given herein below for illustration only, and thus not limitative of this disclosure, wherein.

DETAILED DESCRIPTION

Figure 1:
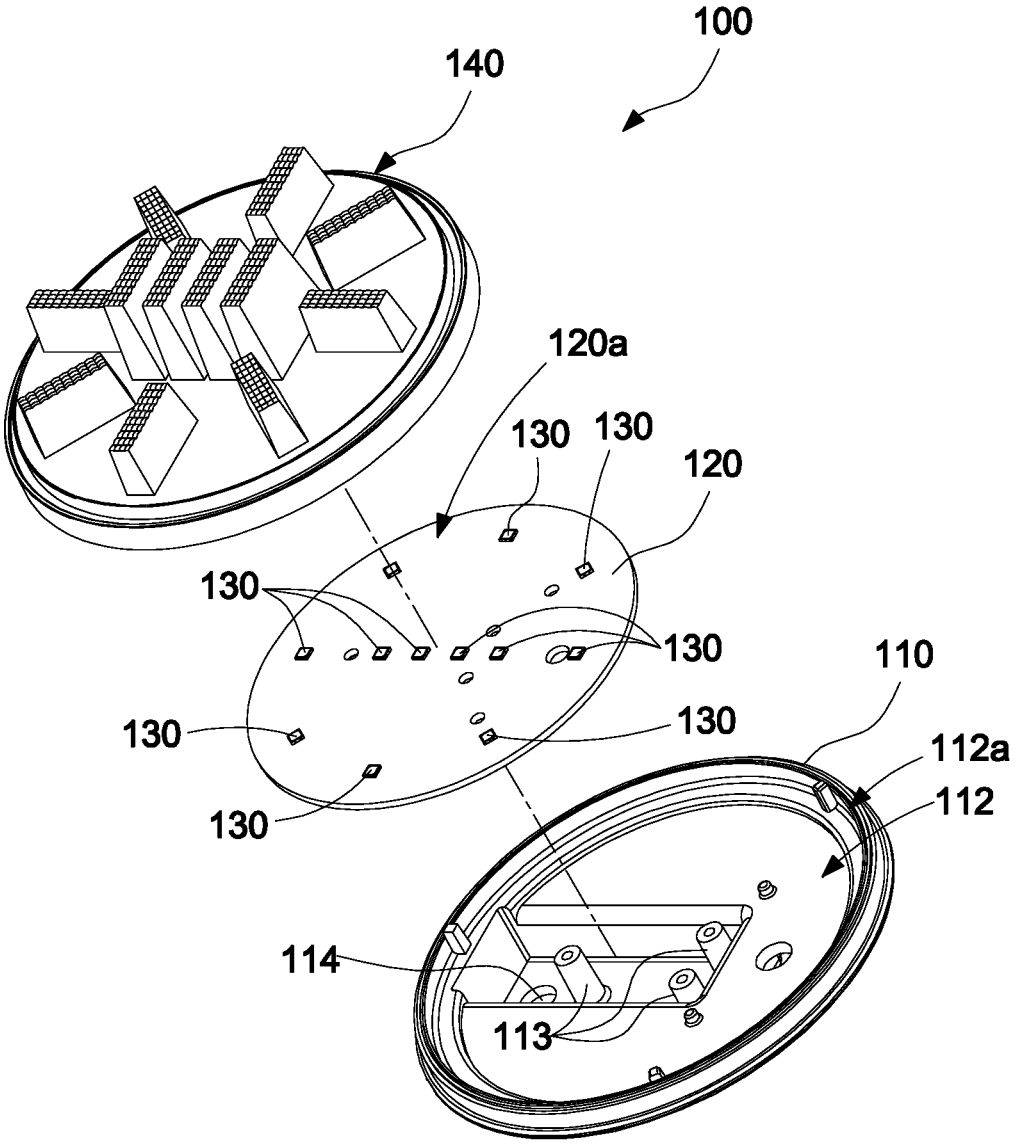
FIG. 1 is an exploded view of a vehicle lamp according to an embodiment of this disclosure.
Figure 2:
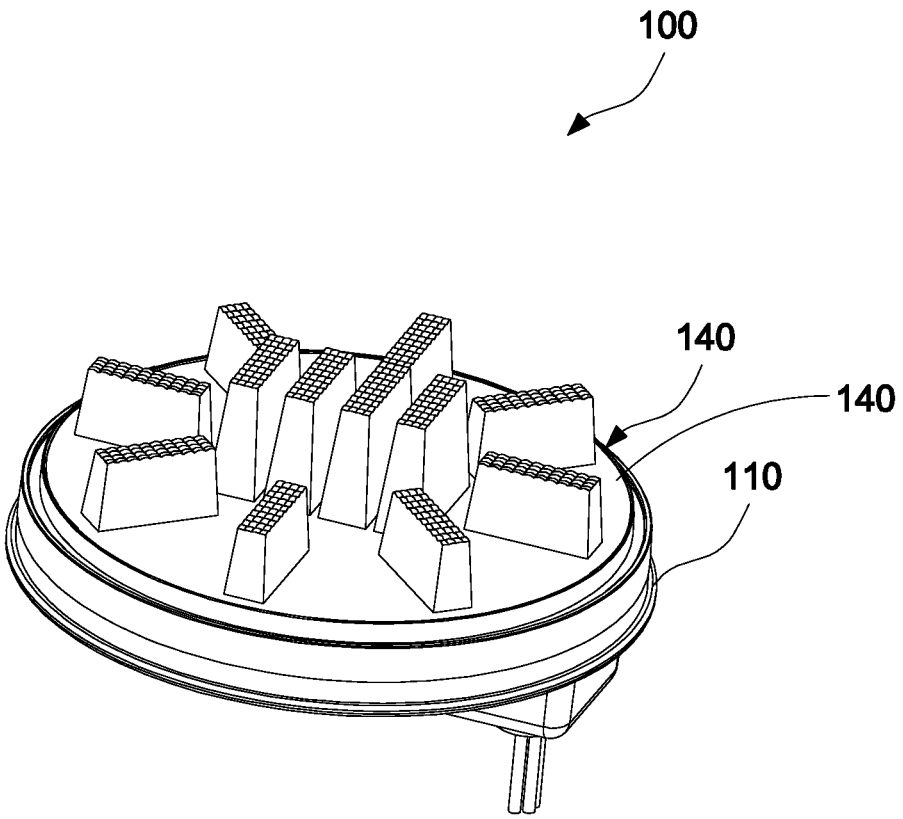
FIG. 2 is a perspective view of the vehicle lamp according to the embodiment of this disclosure.
Figure 3:
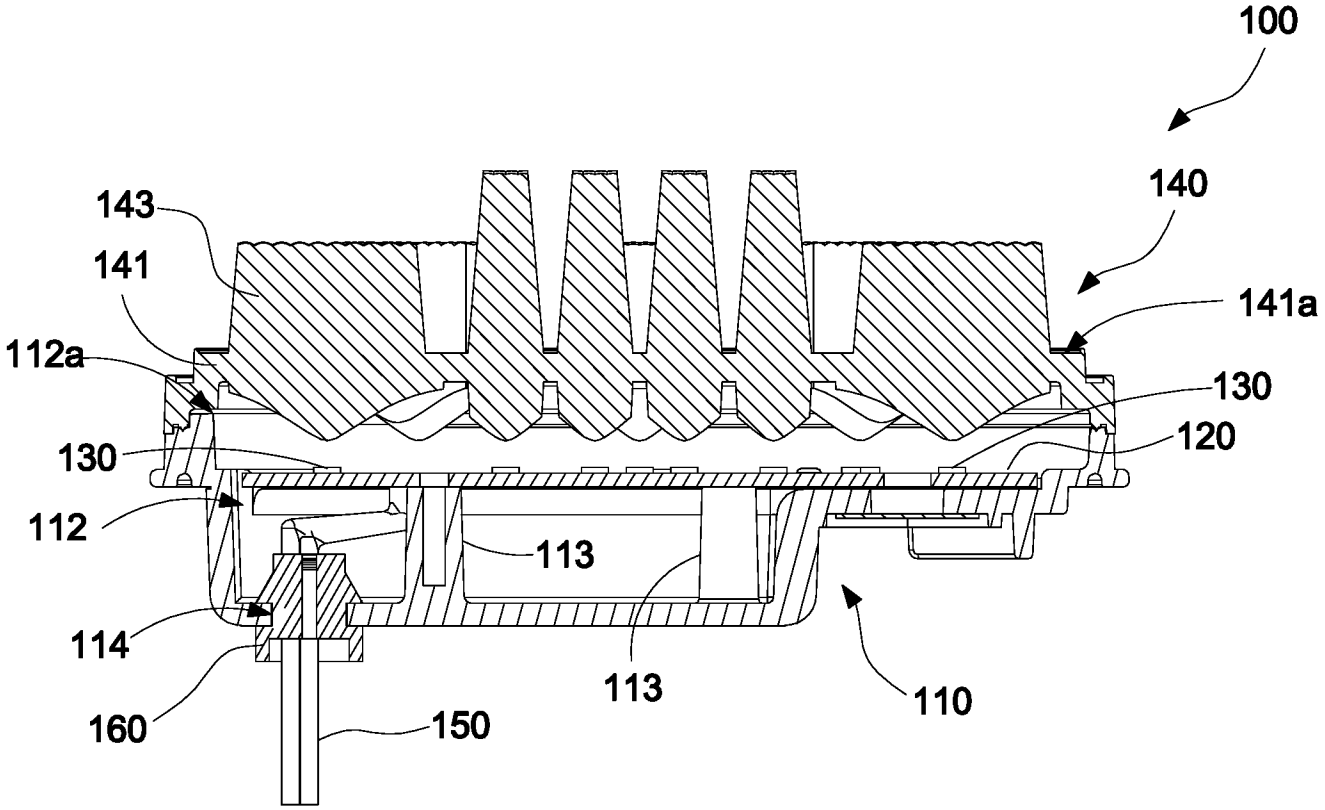
FIG. 3 is a cross-sectional view of the vehicle lamp according the embodiment of this disclosure.

Referring to FIG. 1, FIG. 2 and FIG. 3, a vehicle lamp 100 according to an embodiment of this disclosure includes a lamp housing 110, a carrier board 120, plurality of LEDs (light emitting diodes) 130, an optical unit 140. The lamp housing 110 includes an accommodating space 112 and an opening 112*a* connecting the accommodating space 112.

Figure 4:
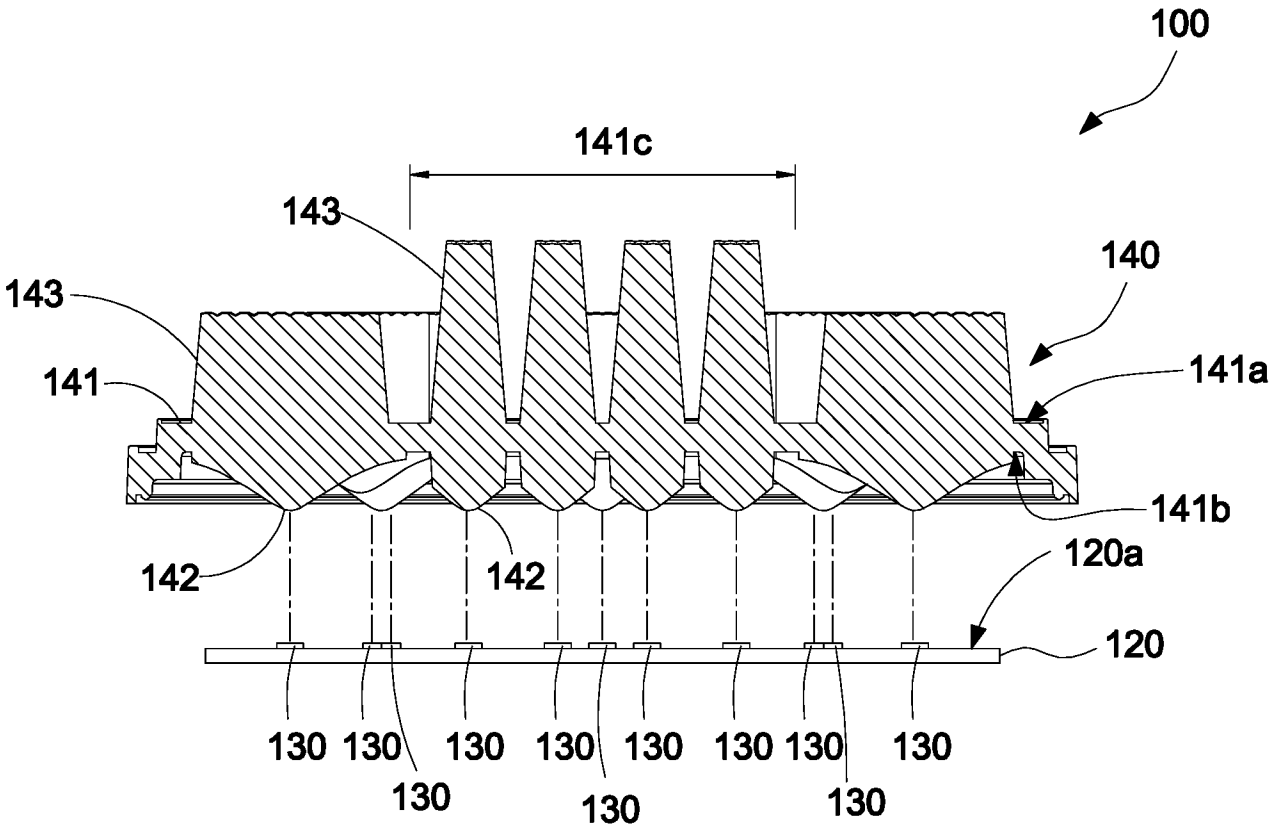
FIG. 4 is a cross-sectional view showing an optical unit, LEDs and a carrier board of the vehicle lamp according to the embodiment of this disclosure.

As shown in FIG. 1, FIG. 3, and FIG. 4, the carrier board 120 is disposed in the accommodating space 112, and a front surface of the carrier board 120 faces the opening 112*a*. The LEDs 130 are disposed on the front surface of the carrier board 120. The carrier board 120 can be a printed circuit board (PCB) with printed circuitry to supply power to each LED 130. Or the carrier board 120 can be made without printed circuitry and made of a material with a high thermal conductivity, for example, the carrier board 120 can be aluminum board; at the same time, this aluminum board is equipped with wires to supply power, and the wires are electrically connected to each LED 130.

As shown in FIG. 1, FIG. 2, FIG. 3, and FIG. 4, the optical unit 140 includes a light guide plate 141, a plurality of light guide members 142 and a plurality of beam pattern adjusting structures 143. The light guide plate 141 includes an upper surface 141*a* and a lower surface 141*b*, the light guide plate 141 covers the opening 112*a*, and the lower surface 141*b* of the light guide plate 141 faces the carrier board 120. The light guide member 142 protrudes the lower surface 141*b*, and each of the light guide members 140 extends towards one of the LEDs 130 to receive light for each of the LEDs 130. The beam pattern adjusting structures 143 protrude on the upper surface 141*a*, and each of the beam pattern adjusting structures 143 is arranged to correspond at least one of the light guide members 142.

The light emitted by the LEDs 130 are received by the light guide members 142 and then enters the optical unit 140. The light passes through the light guide 141 and the beam pattern adjustment structure 143 after refraction, and then the light is refracted and diffused by the beam pattern adjustment structure 143, and finally the light is projected outward by the upper surface 141*a* with a preset beam pattern. The light guide plate 141, the plurality of light guide member 142 and the plurality of beam pattern adjusting structures 143 are made of transparent material (but may have a specific color, such as red or yellow) and are one-piece molded.

As shown in FIG. 4, in one example, each of the beam pattern adjusting structures 143 is configured to correspond to one of the light guide members 142. And the projection of each of the beam pattern adjusting structures 143 on the upper surface 141 overlaps with the projection of the corresponding light guide member 142 on the lower surface 141*b*.

This disclosure does not exclude that the projection of each of beam pattern adjustment structures 143 on upper surface 141 and the projection of light guide member 142 on lower surface 141*b* have same configurations, or the projections only have partial overlap. In addition, the beam pattern adjusting structures 143 and the light guide members 142 are not limited to a one-to-one correspondence. In various embodiments, each beam pattern adjusting structure 143 may correspond to multiple light guide members 142 at the same time, or, multiple beam pattern adjusting structures 143 may correspond to one light guide member 142 at the same time.

The beam pattern adjusting structure 143 is used as a diffusion structure to expand the angle range of the projected light, so that the average illumination is reduced to avoid strong light affecting the vision of people facing the vehicle lamp 100. Meanwhile, the beam pattern adjusting structures 143 increase the angle range of the projected light, so that viewers from different angles can clearly see the vehicle lamp 100 luminous.

As shown in FIG. 1 and FIG. 3, the lamp housing 110 further includes a fixing post 113, disposed in the accommodating space 112, for supporting and fixing the carrier board 120. Furthermore, the lamp housing 110 is provided with a piercing hole 114 for a cable 150 to pass through to connect directly or indirectly electrically to each LED 130, and supply power to each LED 130. The piercing hole 114 can be filled with glue or plugged by a flexible plug 160, and the cable 150 passes through the glue or flexible plug 160 to provide a watertight seal to the piercing hole 114 through the glue or the flexible plug 160.

Figure 5:
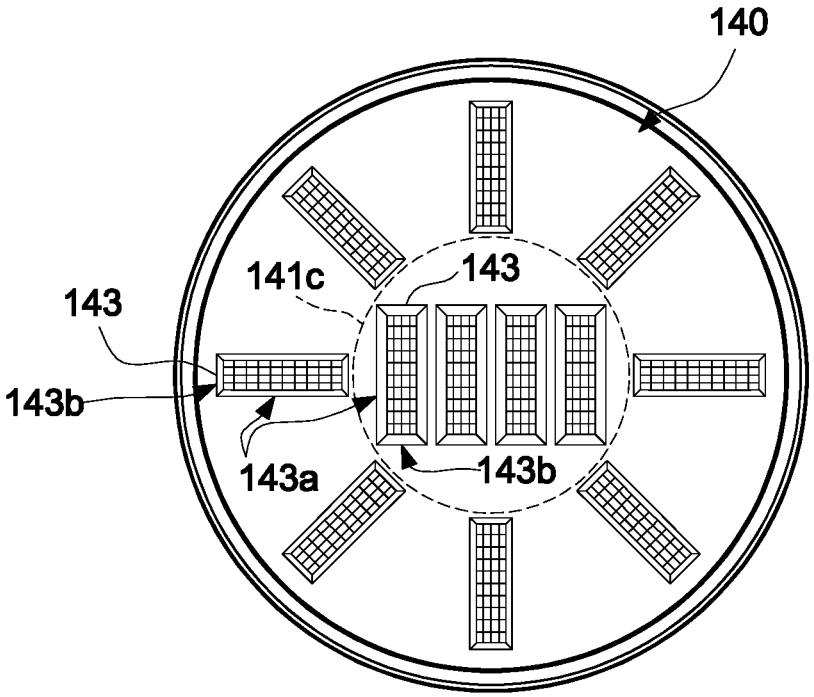
FIG. 5 is a top view of the optical unit of the vehicle lamp according to the embodiment of the this disclosure.
Figure 6:
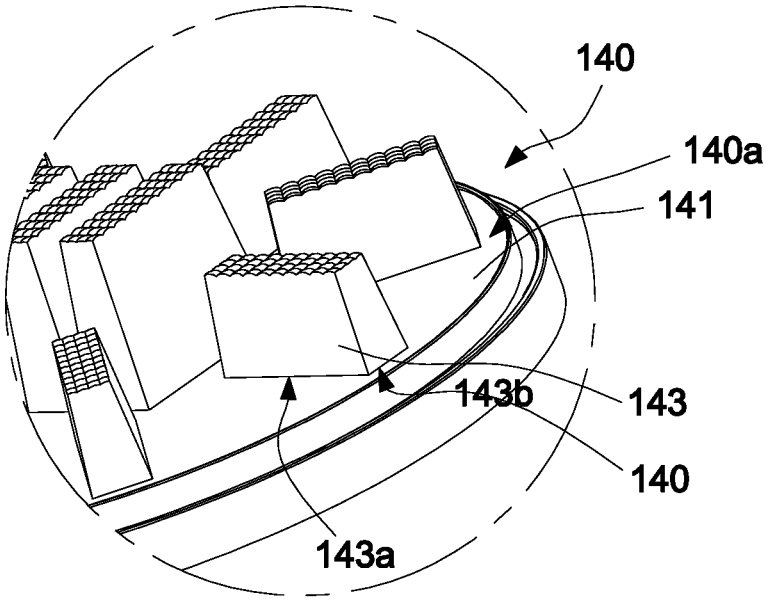
FIG. 6 is a partial perspective view of the optical unit of the vehicle lamp according to the embodiment of this disclosure.

As shown in FIG. 4, FIG. 5, and FIG. 6, in one example, the beam pattern adjusting structures 143 have different heights on the upper surface 141*a*, so as to generate different optical effects. As shown in FIG. 4 and FIG. 5, heights of the beam pattern adjusting structures 143 located with in a center area 141*c* of the upper surface 141*a* are higher than the heights of the beam pattern adjusting structures 143 outside the center area 141*c*. Such that the beam pattern adjusting structures 143 in the center area 141*c* generate optical effects different from the optical effects of the pattern adjusting structures 143 outside the center area 141*c*. The overall beam pattern of the vehicle lamp 100 is adjusted to meet law and regulatory requirements.

As shown in FIG. 5, in one example, the projection of each of the beam pattern adjusting structures 143 on the upper surface 141*a* is rectangular, and each of the projection includes long sides 143*a* and short sides 143*b*. The upper surface 141*a* includes a center area 141*c* and a peripheral area surrounding the center area 141*c*. Each of the beam pattern adjusting structures 143 in the center area 141*c* are arranged with the long sides 143*a* parallel to the long sides 143*a* of the other beam pattern adjusting structures 143. The beam pattern adjusting structures 143 in the peripheral area (outside the center area 141*c*) are arranged with long sides 143*a* in radial arrangement. Optical effects in the center area 141*c* and the peripheral area are different, so as to adjust the overall beam pattern of the vehicle lamp 100.

Figure 7:
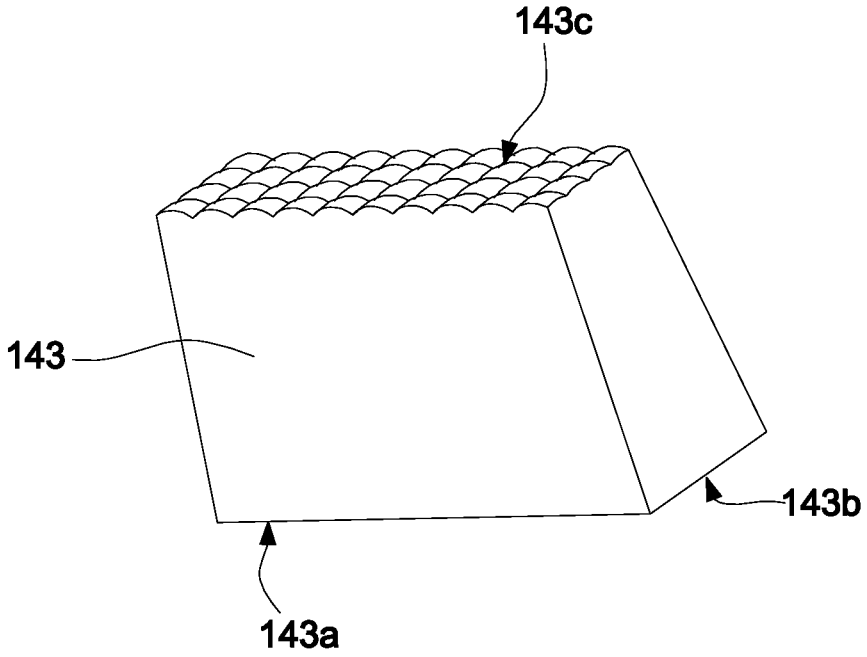
FIG. 7 to FIG. 11 are perspective views of beam pattern adjusting structures according to different embodiments of this disclosure.

As shown in FIG. 6 and FIG. 7, in one example, lateral surfaces of each of the beam pattern adjusting structures 143 corresponding to the long sides 143*a* of the beam pattern adjusting structure 143 are inclined surfaces, and an included angle between each of the inclined surfaces and the upper surface 141*a* of the light guide plate 141 is smaller than 90 degrees. Lateral surfaces of each of the beam pattern adjusting structures 143 corresponding to the short sides 143*b* of the beam pattern adjusting structure 143 are inclined surfaces, and an included angle between each of the inclined surfaces and the upper surface 141*a* of the light guide plate 141 is smaller than 90 degrees. The aforementioned inclined angle is used to adjust the angular range of light emitted from the lateral sides, so as to control the beam pattern variation.

Figure 8:
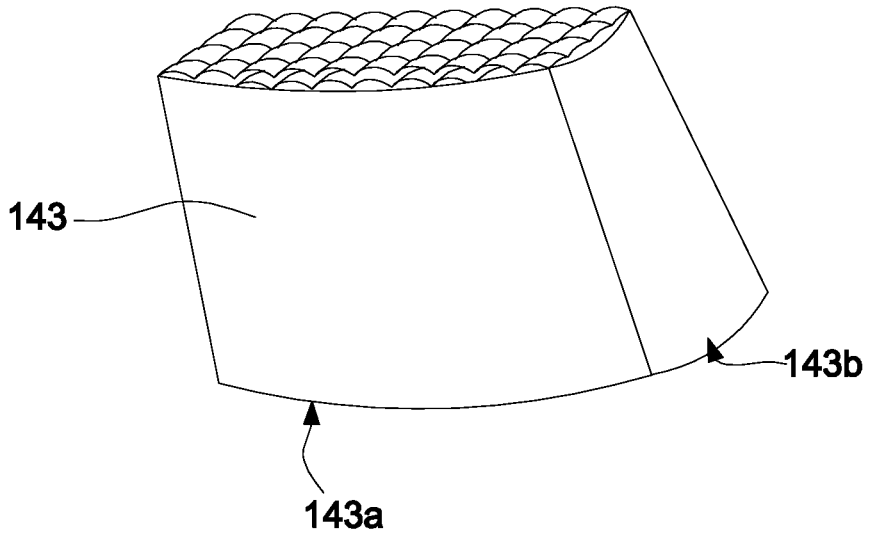
Figure 9:
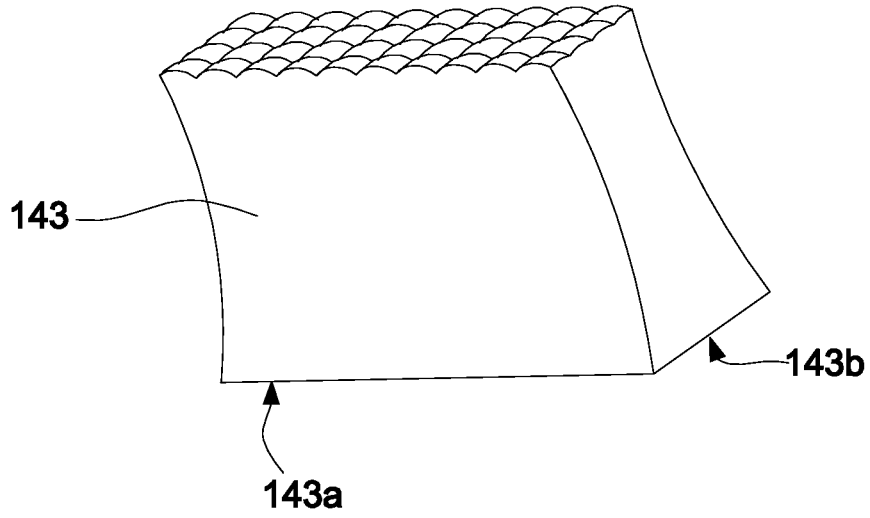

As shown in FIG. 8 and FIG. 9, in different embodiment, lateral surfaces of each of the beam pattern adjusting structures 143 corresponding to the long sides 143*a* of the beam pattern adjusting structure 143 are concave curved surfaces or convex curved surfaces. Lateral surfaces of each of the beam pattern adjusting structures 143 corresponding to the short sides 143*b* of the beam pattern adjusting structure 143 are concave curved surfaces or convex curved surfaces. The aforementioned curvature of the curved surface is used to adjust the angular range of light emitted from the lateral sides, so as to control the beam pattern variation.

Figure 10:
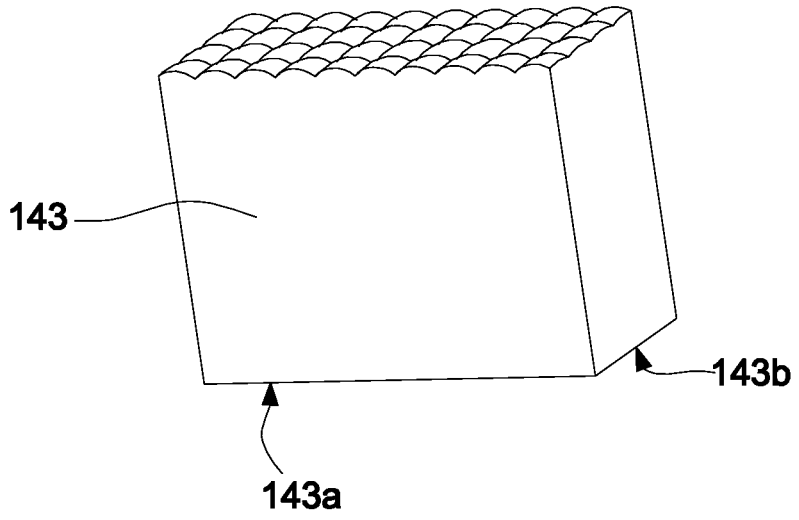
Figure 11:
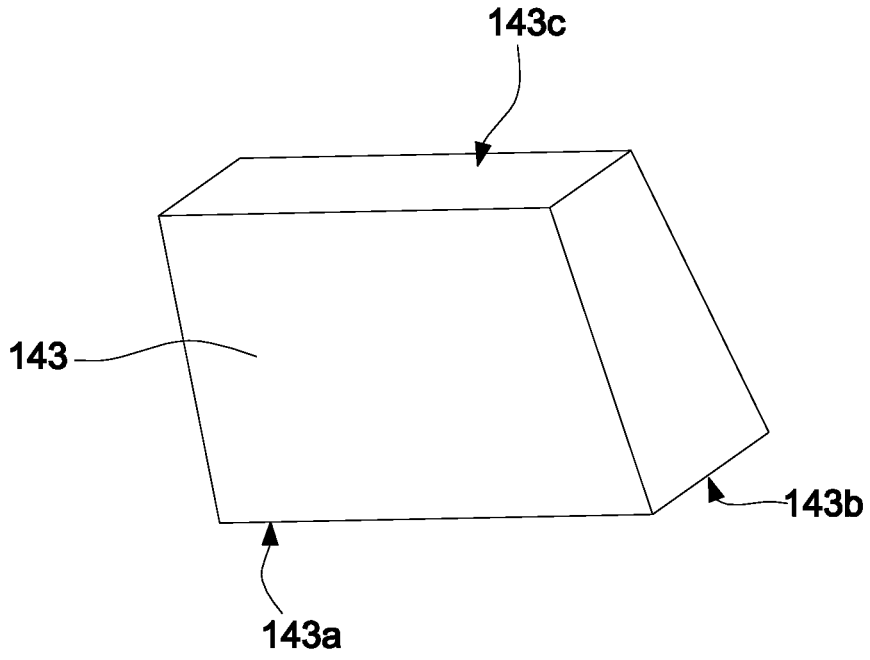

As shown in FIG. 10, in another embodiment, lateral surfaces of each of the beam pattern adjusting structures 143 corresponding to the long sides 143*a* of the beam pattern adjusting structures 143 are planar surfaces perpendicular to the upper surface 141*a* of the light guide plate 141. lateral surfaces of each of the beam pattern adjusting structures 143 corresponding to the short sides 143*b* of the beam pattern adjusting structures 143 are planar surfaces perpendicular to the upper surface 141*a* of the light guide plate 141. The aforementioned vertical plane perpendicular to the upper surface 141*a* can reduce the brightness of the vehicle lamp 100 in the front direction, and enhance the brightness in the lateral direction.

Figure 12:
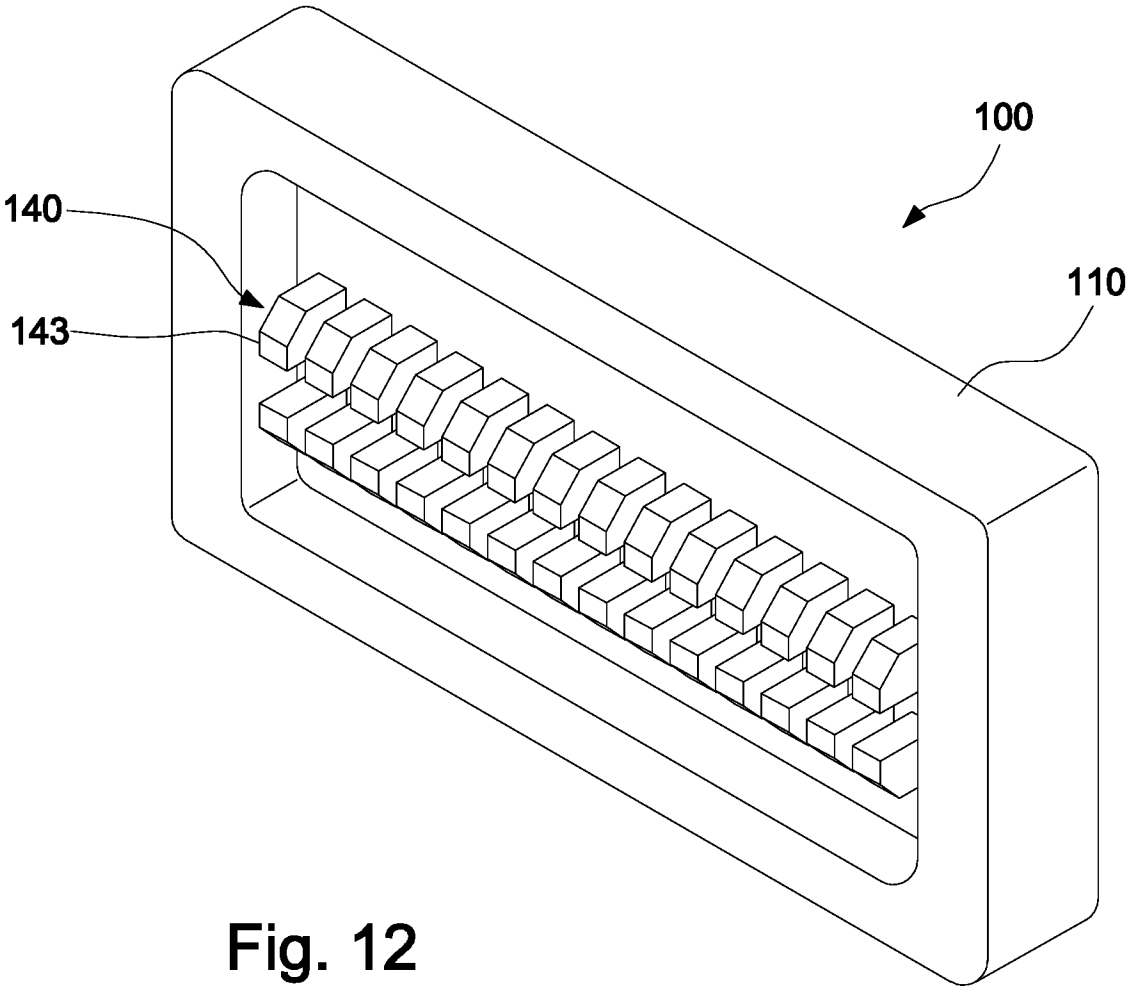
FIG. 12 is a perspective view of a vehicle lamp according to another embodiment of this disclosure.

Please refer to FIG. 12, a vehicle lamp 100 according to another embodiment of this disclosure includes a lamp housing 110, a carrier board (not shown in the drawings), plurality of LEDs (not shown in the drawings), and an optical unit 140. The lamp housing 110, the carrier board, and the plurality of LEDs have substantially the same structure as the previous embodiment. The structure of the lamp housing 110, the carrier board, and the plurality of LEDs is substantially the same as that of the preceding embodiment and will not be described hereinafter.

Figure 14:
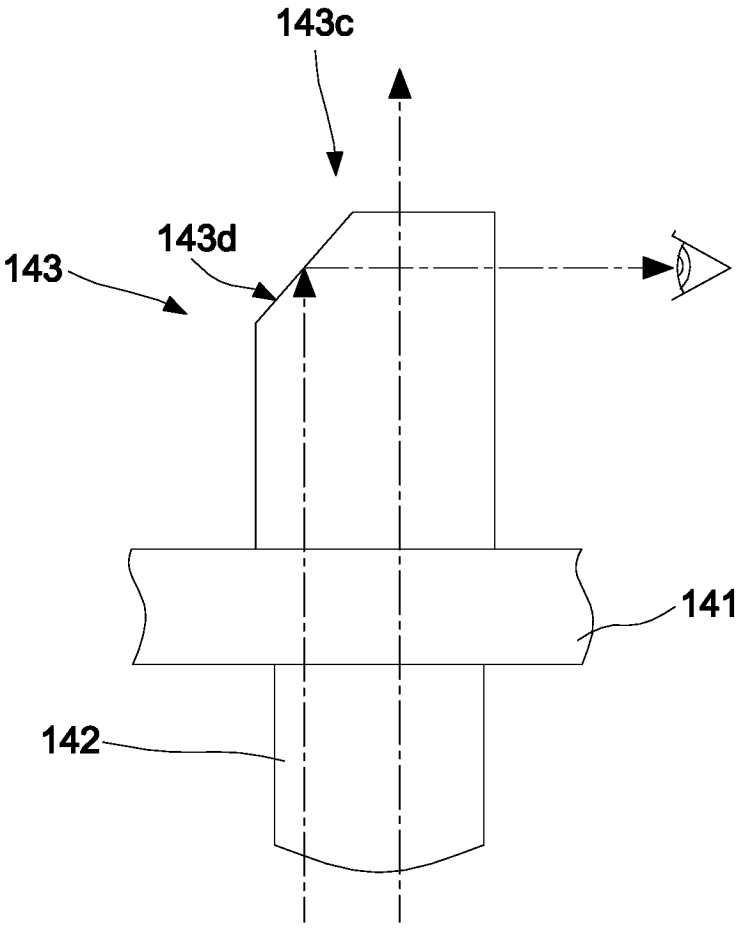
FIG. 14 to FIG. 16 are lateral views of optical units according to different embodiments of this disclosure.
Figure 13:
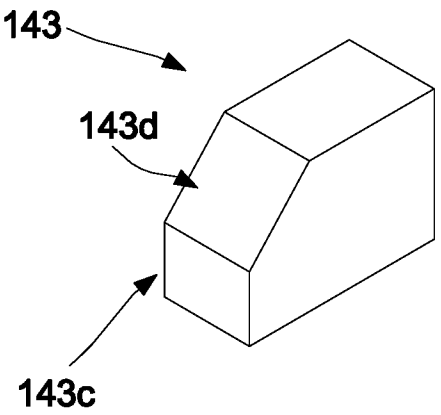
FIG. 13 is an enlarged perspective view of a beam pattern adjusting structure of the vehicle lamp according to another embodiment of this disclosure.

As shown in FIG. 12, FIG. 13 and FIG. 14, the top surface 143*c* of each beam pattern adjusting structure 143 is partially provided with an oblique cut surface 143*d*. The oblique cut surface 143*d* is not parallel to the upper surface 141*a* of the light guide plate 141 and has an angle between the top surface 143*c* and the oblique cut surface 143*d*. The light emitted from the LED is received by the light guide member 142, passes through the light guide plate 141, enters the beam pattern adjusting structure 143, and then the light further falls on the oblique cut surface 143*d*. The light on the oblique cut surface 143*d* will have an angle of incidence that is not equal to zero. At this time, at least part of the light falling on the oblique cut surface 143*d* will be reflected to the lateral side of the beam pattern adjusting structure 143, such that the observer can observe the luminescence from the lateral side of the vehicle lamp 100.

Therefore, the brightness of the light in the front side of the vehicle lamp 100 is reduced, while the brightness of the lateral side of the vehicle lamp 100 is increased. The angle range of the light emitted from the lateral side of the beam pattern adjusting structure 143 is increased to adjust the beam pattern, so that the observer can observe the vehicle lamp 100 being lit from various angles. The aforementioned incidence angle can be arranged as partial or total reflection.

In the case of total reflection, the top surface 143*c* of each beam pattern adjusting structure 143 may retain part of the planar design, so that part of the light can still be emitted through the top surface 143*c* at an incidence angle of zero degrees, while maintaining the brightness of the vehicle lamp 100 in the front side.

Figure 15:
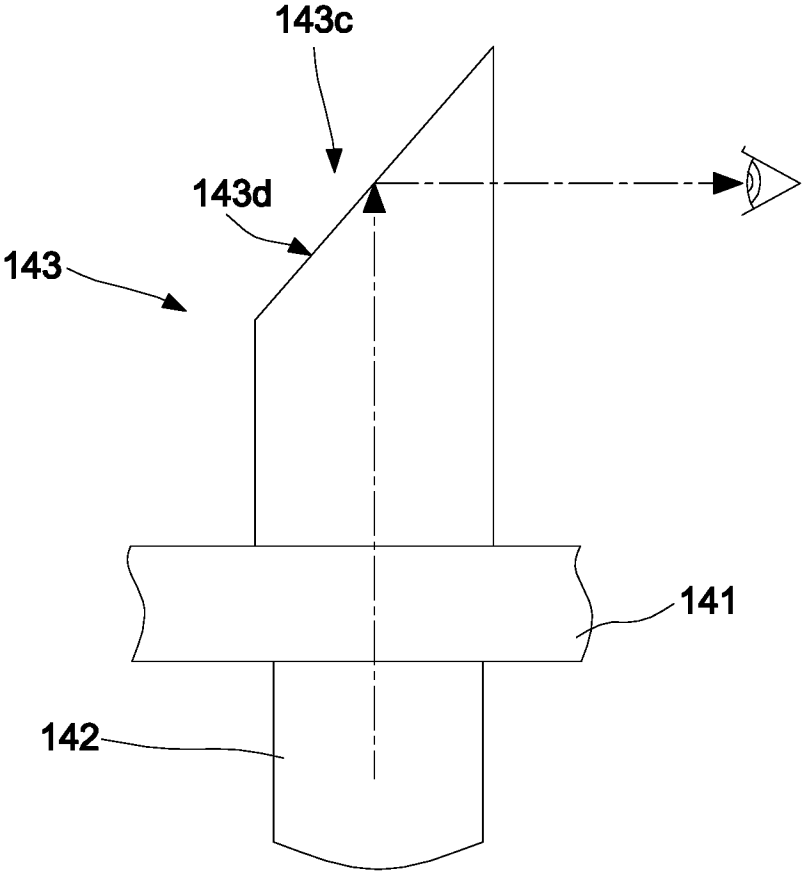

As shown in FIG. 15, when the oblique cut surface 143*d* is set to an angle at which the light is partially reflected and partially not reflected (i.e., the light is refracted by the oblique cut surface 143*d*), the top surface 143*c* of the beam pattern adjusting structure 143 can all be set to oblique cut surface 143*d* without retaining the flat configuration.

Figure 16:
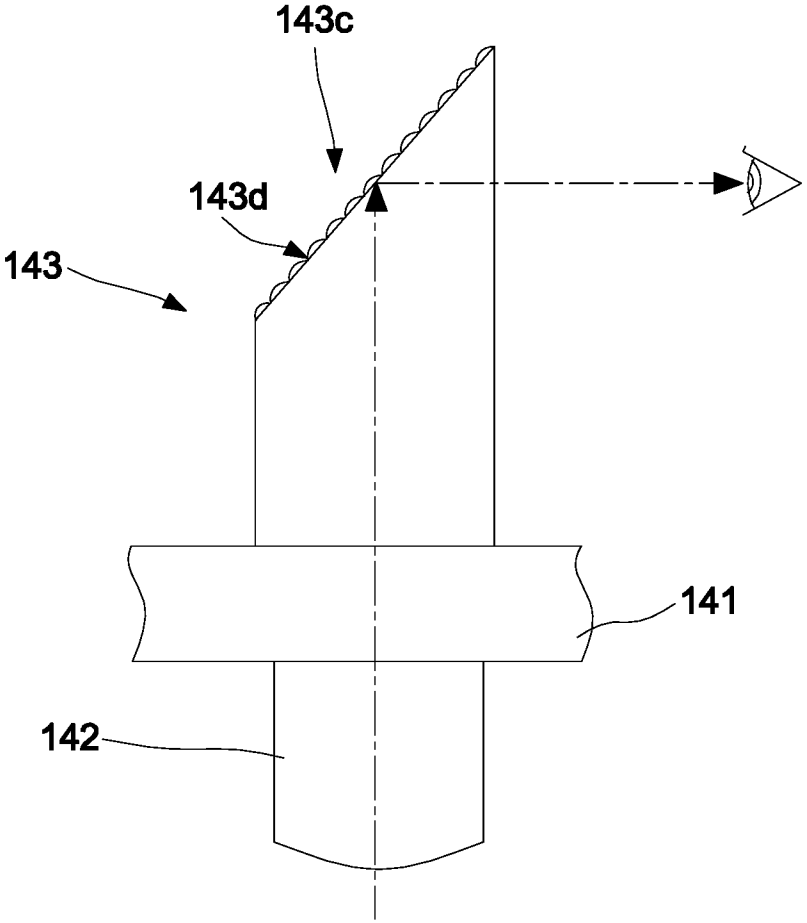

As shown in FIG. 16, the top surface 143*c* of the beam pattern adjusting structure 143 may be all set to the oblique cut surface 143*d* without retaining the flat configuration. At this time, in order to adjust the brightness of light on the front side of the vehicle lamp 100, the oblique cut surface 143*d* can be further set as optical diffusion surface to meet the beam pattern, luminous angle range and/or average illumination requirements.

Through the above-mentioned approach, the light transmissive cover and optical units on each of the LEDs in the art are replaced by a single optical unit. Therefore, a structure of the vehicle lamp is simplified, and the optical unit can be easily replaced. In addition, in this disclosure, the light only needs to pass through one optical medium, and no longer needs to pass through the light transmissive cover, which greatly reduces the illumination degradation rate. Therefore, in this disclosure, the operation power of individual LEDs can be reduced, which improves LED life, reduces heat dissipation problems, and reduces production cost.

What is claimed is:

1. A vehicle lamp, comprising:

a lamp housing, including an accommodating space and an opening connecting the accommodating space;

a carrier board, disposed in the accommodating space, and a front surface of the carrier board facing the opening; a plurality of LEDs, disposed on the front surface of the carrier board; and an optical unit, including a light guide plate, a plurality of light guide members, and a plurality of beam pattern adjusting structures;

wherein, the light guide plate includes an upper surface and a lower surface, and the light guide plate covers the opening, and the lower surface of the light guide plate faces the carrier board;

wherein, the light guide members protrude on the lower surface, and each of the light guide members extends towards one of the LEDs, the beam pattern adjusting structures protrude on the upper surface, and each of the beam pattern adjusting structures corresponds at least one of the light guide members;

wherein a projection of each of the beam pattern adjusting structures of the upper surface of the light guide plate overlaps with the projection of the corresponding light guide member on the lower surface of the light guide member; and wherein heights of the beam pattern adjusting structures located within a center area of the upper surface are higher than the heights of the beam pattern adjusting structures located outside the center area.

2. The vehicle lamp as claimed in claim 1, wherein the beam pattern adjusting structures include different heights on the upper surface of the light guide plate.

3. The vehicle lamp as claimed in claim 1, wherein projections of the least one of the beam pattern adjusting structures on the upper surface are rectangular, and each of the projection includes long sides and short sides.

4. The vehicle lamp as claimed in claim 3, wherein the upper surface includes a center area and a peripheral area surrounding the center area, and each of the beam pattern adjusting structures in the center area are arranged with the long sides parallel to the long sides of other beam pattern adjusting structure.

5. The vehicle lamp as claimed in claim 3, wherein the upper surface includes a center area and a peripheral area surrounding the center area, and the beam pattern adjusting structures in the peripheral area are arranged with long sides in radial arrangement.

6. The vehicle lamp as claimed in claim 3, wherein lateral surfaces of each of the beam pattern adjusting structures corresponding to the long sides of the beam pattern adjusting structure are inclined surfaces, and an included angle between each of the inclined surfaces and the upper surface of the light guide plate is smaller than 90 degrees.

7. The vehicle lamp as claimed in claim 3, wherein lateral surfaces of each of the beam pattern adjusting structures corresponding to the long sides of the beam pattern adjusting structure are concave curved surfaces or convex curved surfaces.

8. The vehicle lamp as claimed in claim 3, wherein lateral surfaces of each of the beam pattern adjusting structures corresponding to the long sides of the beam pattern adjusting structure are planar surfaces perpendicular to the upper surface of the light guide plate.

9. The vehicle lamp as claimed in claim 3, wherein lateral surfaces of each of the beam pattern adjusting structures corresponding to the short sides of the beam pattern adjusting structure are inclined surfaces, and an included angle between each of the inclined surfaces and the upper surface of the light guide plate is smaller than 90 degrees.

10. The vehicle lamp as claimed in claim 3, wherein lateral surfaces of each of the beam pattern adjusting structures corresponding to the short sides of the beam pattern adjusting structure are concave curved surfaces or convex curved surfaces.

11. The vehicle lamp as claimed in claim 3, wherein lateral surfaces of each of the beam pattern adjusting structures corresponding to the short sides of the beam pattern adjusting structure are planar surfaces perpendicular to the upper surface of the light guide plate.

12. The vehicle lamp as claimed in claim 3, wherein a top surface of each of the beam pattern adjusting structures is an optical diffusion surface with concave and convex structures.

13. The vehicle lamp as claimed in claim 3, wherein a top surface of each of the beam pattern adjusting structures is a planar surface.

14. The vehicle lamp as claimed in claim 1, wherein the lamp housing further includes a fixing post disposed in the accommodating space for supporting and fixing the carrier board.

* * * * *